US006170706B1

(12) United States Patent
Havlovitz

(10) Patent No.: US 6,170,706 B1
(45) Date of Patent: Jan. 9, 2001

(54) HAND HOLDABLE PUMP SPRAY SYSTEM

(75) Inventor: Paul M. Havlovitz, Dublin, OH (US)

(73) Assignee: OMS Investments, Inc., Wilmington, DE (US)

( * ) Notice: Under 35 U.S.C. 154(b), the term of this patent shall be extended for 0 days.

(21) Appl. No.: 09/457,171

(22) Filed: Dec. 8, 1999

(51) Int. Cl.[7] ..... B67D 1/16

(52) U.S. Cl. ..... 222/109; 222/340; 222/518; 222/530; 239/373; 417/571; 417/510; 251/353

(58) Field of Search ..... 239/373, 333, 239/331, 329; 222/323, 340, 109, 518, 545, 528, 464.1, 382, 530; 417/571, 566, 540, 471; 251/353, 354

(56) References Cited

U.S. PATENT DOCUMENTS

| | | | | |
|---|---|---|---|---|
| D. 402,205 | | 12/1998 | Shanklin et al. . | |
| D. 407,312 | | 3/1999 | Shanklin et al. . | |
| 665,914 | * | 1/1901 | Kindermann | 222/340 |
| 1,671,779 | * | 5/1928 | Pearsons | 222/340 |
| 1,681,845 | * | 8/1928 | Dilley et al. | 222/323 |
| 2,060,297 | | 11/1936 | Fox . | |
| 2,232,522 | | 2/1941 | Gray . | |
| 2,474,748 | * | 6/1949 | McMurray | 222/340 |
| 2,545,319 | * | 3/1951 | Sundholm | 222/340 |
| 3,002,699 | * | 10/1961 | Pinke | 239/333 |
| 3,092,330 | * | 6/1963 | Ridenour et al. | 239/333 |
| 3,730,398 | | 5/1973 | Goda . | |
| 4,174,055 | | 11/1979 | Capra et al. . | |
| 5,373,973 | | 12/1994 | Foster . | |
| 5,469,993 | | 11/1995 | Hauf et al. . | |
| 5,485,942 | | 1/1996 | Foster . | |
| 5,553,750 | | 9/1996 | Foster . | |
| 5,601,211 | | 2/1997 | Foster . | |
| 5,609,272 | | 3/1997 | Brass et al. . | |
| 5,649,664 | * | 7/1997 | Brass et al. | 251/353 |
| 5,651,908 | | 7/1997 | Mansfield . | |
| 5,810,211 | | 9/1998 | Shanklin et al. . | |
| 5,816,447 | | 10/1998 | Shanklin et al. . | |
| 5,860,574 | | 1/1999 | Shanklin et al. . | |
| 5,918,782 | | 7/1999 | Shanklin et al. . | |
| 5,938,116 | | 8/1999 | Restive et al. . | |

* cited by examiner

*Primary Examiner*—Andres Kashnikow
*Assistant Examiner*—Dinh Q. Nguyen
(74) *Attorney, Agent, or Firm*—Jones, Day, Reavis & Pogue

(57) ABSTRACT

A hand holdable pump spray system where the pump mechanism is in the hand holdable wand rather than in the liquid container. The wand may be held with one hand while the pump handle is extended with the other hand. This creates a pressure differential which allows liquid to flow from the container into the wand. A biased spring provides force against the liquid so that when a thumb actuated trigger opens the nozzle, the liquid will be ejected. Should all of the liquid not be ejected, there is a liquid return mechanism which opens a check valve and allows the liquid to return to the container through a supply tube connecting the wand and the container.

22 Claims, 6 Drawing Sheets

HAND HOLDABLE PUMP SPRAY SYSTEM

BACKGROUND OF THE INVENTION

1. Field of the Invention

The present invention relates to a hand holdable pump spray system and a pump spray apparatus and more particularly to a hand holdable pump spray system and apparatus which is easier to use, safer and less expensive.

2. Description of the Related Art

Non-aerosol pump spraying devices have been developed primarily to eliminate the use of propellants which have a detrimental effect on the environment and to eliminate the use of pressurized containers which pose a safety hazard. Pressurized containers may explode and cause injury, and when the containers have ingredients such as insecticide, weed and grass killer and fertilizer, there may be undesirable environmental affects. Examples of non-aerosol pump spray apparatus may be seen by reference to U.S. Pat. Nos. 5,938,116; 5,918,782; 5,860,574; 5,816,447; 5,810,211 and 4,174,055.

A drawback to all of such non-aerosol pump apparatus is that the pump device is located in the container having the liquid to be pumped. There is then a flexible tube connecting the container to a hand holdable spray device or "wand". Typically, the container is sold as a disposable unit to be discarded when no more liquid can be pumped from the container. This results in a relatively high cost because the pump mechanism, located within the container, is also discarded along with the container. Another problem of pump-in-container designs is that the hand held wand must be set down or held in an awkward position when the pump is to be operated because two hands are necessary to manipulate the pump. For example, when it comes time to operate the spraying device, the pump must be activated to pressurize at least part of the system. Usually this means there a need to pull upwardly on a handle attached to a piston located in the container. While this is done with one hand, the other hand must hold the container "down" to counteract the upward pull on the handle. Hence, it is difficult to also hold the wand at the same time.

There are also safety issues made especially more relevant because of the nature of the liquid being sprayed. There are at least two potential safety problems. First, there is a need to seal the container when it is shipped from the factory and again when stored by a consumer. Secondly, there is a need to safely transfer the liquid which has been pumped from the container into the hand holdable wand but which was not discharged during use.

Finally, there may also be a safety problem regarding unused liquid in the container at the time of disposal. It is, of course, economically more efficient to use as much of the liquid as possible before disposal, and it is better to have as little liquid remaining in the container as possible at the time of disposal. It is understood that it is difficult, if not impossible, to completely empty a container using a non-aerosol pump, and opening the spout of the container is not recommended because of the nature of the liquid within.

The numerous prior attempts to improve upon non-aerosol pump spray devices have yet to produce an optimal system.

BRIEF SUMMARY OF THE INVENTION

The difficulties encountered by the previous systems have been overcome by the present invention. What is described here is a hand holdable pump spray apparatus comprising a generally tubular hand holdable housing having first and second end portions, a piston having two faces movable in the housing, a handle connected to the piston adapted to be gripped by a user to move the piston, a spring located in the housing between one face of the piston and the first end portion of the housing to bias the piston toward the second end portion of the housing, a chamber formed in the housing between the other face of the piston and the second end portion of the housing, another chamber formed in the second end portion of the housing operatively connected to a container holding a liquid to be sprayed, a valve located in the second end portion of the housing to separate the two chambers, another valve connected to the second end portion of the housing to control liquid leaving the first mentioned chamber, a nozzle connected to the second end portion of the housing and engaged to the second mentioned valve, another spring engaging the nozzle and biasing the nozzle away from the second end portion of the housing, and a trigger for moving the nozzle and the second valve toward the first end portion of the housing whereby liquid in the first chamber may be ejected through the nozzle.

The present invention also includes a hand holdable pump spray system comprising the apparatus described above, a container for the liquid to be sprayed and a supply tube connecting the apparatus and the container.

There are a number of advantages, features and objects achieved with the present invention not available in prior devices. For example, one advantage is that the present invention provides a non-aerosol hand holdable pump spray apparatus which may be operated without the need to set the spray apparatus or wand down or to hold it in an awkward position in order to operate the pump. Another advantage of the present invention is that the pump spray wand and container combination is relatively inexpensive in that the container is disposable after use but the pump mechanism in the wand may be reused. Another aspect of the present invention is to provide a system with a safety de-pressurizing mechanism for allowing unsprayed liquid in the wand and in the connected flexible tube to be transferred back into the container where it can be safely stored until the next use. Yet another feature of the present invention is to provide a simple container valve whose position is visually apparent to ensure that the container is sealed when not in use or when it is transported, thereby preventing inadvertent leakage of environmentally unfriendly liquids. A further feature of the present invention is to provide a mechanism which allows the container to be emptied more completely than can be accomplished by prior pump spray devices.

A more complete understanding of the present invention and other advantages, objects, aspects, aims and features thereof will be gained from a consideration of the following preferred embodiments read in conjunction with the accompanying drawings provided herein.

DETAILED DESCRIPTION OF THE INVENTION

Figure 1:
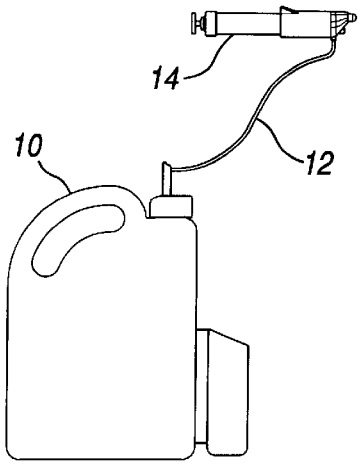
FIG. 1 is a front elevational view of the hand holdable pump spray system of the present invention.

While the present invention is open to various modifications and alternative constructions, the preferred embodiments shown in the drawings will be described herein in detail. It is understood, however, that there is no intention to limit the invention to the particular forms disclosed. On the contrary, the intention is to cover all modifications, variations, equivalent structures and methods, and alternative constructions falling within the spirit and scope of the invention as expressed in the appended claims.

Referring now to FIG. 1, the hand holdable non-aerosol pump spray system is defined generally to include a container 10 acting as a liquid reservoir, to which is connected a supply tube 12 which in turn is connected to a hand holdable pump spray apparatus or wand 14. There are a number of major advantages to having a pump placed in the wand rather than in the container as shown in the earlier patents listed above. By placing the pump in the wand, the pump is much easier to use. There is no need to release the wand nor to hold it in an awkward position when operating the pump. A user can use one hand to hold the wand 14 while the other hand draws back the pump's piston as will be explained below. When this is being done, there is no need to hold down or even to touch the container itself; unlike the previous devices, there is no need to press the container downwardly in opposition to an upward force on the pump because there are no additional forces acting upon the container when the pump is manipulated. A second major feature is that manufacturing costs are reduced. This comes about in two ways. First, the placement of the pump in the wand simplifies the design and reduces the number of parts thereby reducing cost. Second, not having the pump mechanism in the container means that the disposable container is a much cheaper item to make.

Another advantage relates to the handling of liquid in the container. Because it may not be desirable to directly touch the liquid in the container 10, even though only a relatively small residual amount is left after use, it is desirable to dispose of the container. By having the pump mechanism in the wand, the wand and the supply tube may be disengaged from the container and used again with a new, completely filled container. The wand and supply tube are simply disconnected from the spent container and the container is sealed using a simple but effective valve.

Figure 3:
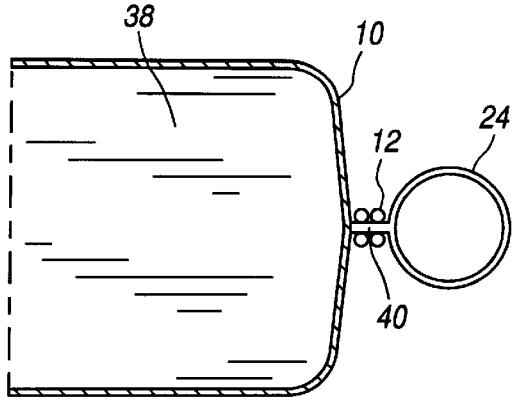
FIG. 3 is a sectional view taken along line 3—3 of FIG. 2 but without the hand holdable wand.
Figure 2:
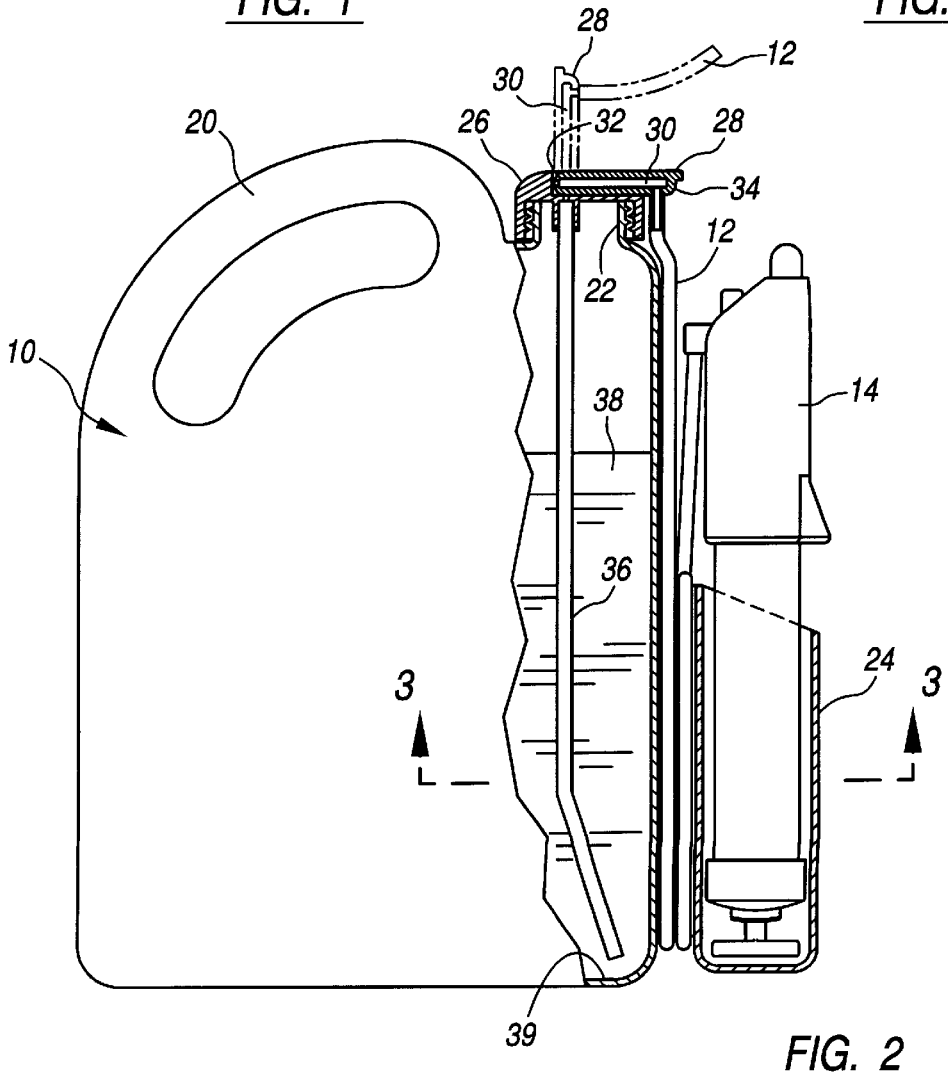
FIG. 2 is an enlarged front elevational view, partially broken away showing the hand holdable pump spray system as it would be in storage or during shipping and further illustrating a container safety valve in a closed position in solid line and in an open position in phantom line.

Referring now to FIGS. 2 and 3, the container will be described in more detail. The container may be made of any suitable synthetic resin, such as high density polyethylene, using a blow molding technique, to achieve a container having an integral handle 20, a spout 22 and a storage sleeve 24. A special safety cap 26 is also provided. This cap has a pivotal valve 28. The pivotal valve provides a safety feature. It allows a user to determine by simple visual inspection whether the valve is open or closed. The pivotal valve 28 is connected to the top of the cap 26 which in turn is attached or threaded to the container spout 22. The pivotal valve includes a central opening 30 which forms a passageway from a first end 32 of the valve toward an opposite end portion 34. Connected to the end portion 34 in any suitable fashion is the supply tube 12.

The valve is mounted to the cap so as to be pivotal relative to the cap. The first end 32 rotates from a position shown in solid line in FIG. 2, where the valve 28 is generally horizontal, as is the central opening 30, to a position shown in phantom line where the valve 28 is generally vertically aligned. This vertical position allows the central opening 30 to align with a liquid transferring internal tube 36 extending downwardly from the cap 26 to or very near the bottom 39 of the container 10. By having this central opening 30 aligned with the internal tube 36, there is a direct passageway between a liquid 38 in the container 10 and the wand 14. The passageway extends through the internal tube 36, the valve 28 and the supply tube 12. However, when the valve 28 is pivoted to its horizontal position, it can be seen that this passageway is closed or blocked. This seals the liquid within the container. The pivoting valve is safe, relatively inexpensive and provides by visual inspection immediate information to a user as to whether the container is open or closed.

A further advantage is that when the container is emptied, except for a residual, the container, the cap, and the internal tube may be properly discarded after the supply tube has been disconnected from the valve 28. It may now be appreciated that the elements of the system being made for disposal are relatively inexpensive while the more expensive elements such as the pump in the wand are reuseable.

The storage/shipping sleeve 24 is provided to allow storage of the wand 14 when the system is shipped or stored. Between the sleeve and the container is an integral bridge flange 40. The flange provides a base around which the supply tube may be wrapped when the wand is placed in the sleeve. As shown in solid line in FIG. 2, the system is in condition to be shipped in a relatively compact arrangement and, of course, in a non-pressurized state. Again, this feature reduces costs and enhances safety.

Figure 4:
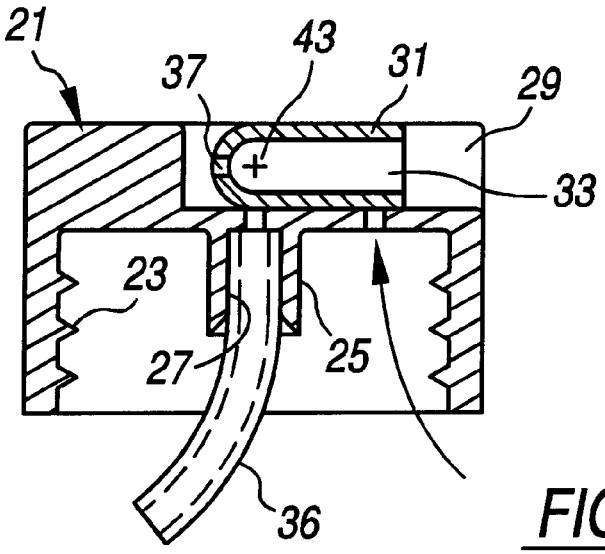
FIG. 4 is an enlarged elevational sectional view of a variation valve cap for the container, where the valve is shown in a closed position.
Figure 5:
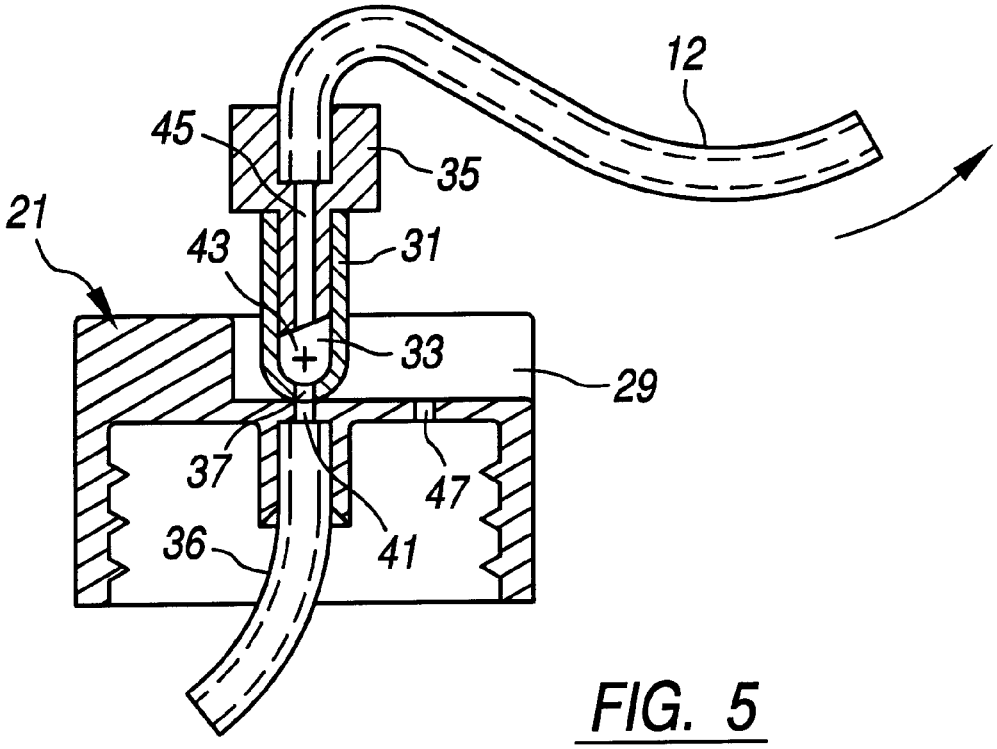
FIG. 5 is the valve cap of FIG. 4 showing the valve in an open position and connected to a supply tube.

Referring now to FIGS. 4 and 5, there is illustrated a variation of the cap and valve connected to the top of the container. The modified cap 21 has an internal thread 23 for engaging a complementary thread (not shown) about the spout of the container. The cap 21 includes an integral sleeve 25 for receiving the upper end portion 27 of the internal tube 36. A slot 29 is formed in the top of the cap to which is pivotally mounted a valve element 31. The valve element 31 is generally tubular and includes a central passageway 33 for receiving a connector 35 affixed to the end of the supply tube 12. The connector has a central opening 45 and may engage the valve element 31 in the central passageway 33 as shown in FIG. 5. The valve element also includes an end opening 37 which communicates with the central passageway so that the valve element may have liquid pass through its entire longitudinal length. A vent opening 47 is also provided in the cap to allow pressure equalization during use, and a liquid opening 41 is provided to align with the internal tube 36 and the end opening 37 of the valve element 31 as shown in FIG. 5.

As with the valve embodiment in FIG. 2, the valve element 31 is closed when in the horizontal position as shown in FIG. 4. When horizontal, both the liquid opening 41 and the vent opening 47 are blocked so that the container is sealed. Also, because of the geometry of the slot 29 and the connector 35, the connector must be removed before the container is sealed. This is another safety feature because, if properly used, all of the liquid in the wand and the supply tube will be returned to the container as will be explained below.

When an operator wishes to dispense the liquid, the valve elements is pivoted upwardly about a pivot point 43 and the connector is plugged into the central passageway 33 as shown in FIG. 5. When the valve element is fully upright, there is a clear passage for the liquid in the container to the wand through the internal tube 36, the liquid opening 41, the end opening 37, the central passageway 33, the central opening 45 in the connector, and the supply tube 12.

Referring now to FIGS. 6–9, the hand holdable pump spray apparatus is shown in more detail. The wand 14 includes a hand holdable tubular housing 44 having a first or left end portion 46 and a second or right end portion 48. Within the housing is a piston 50 movable between the first and second end portions of the housing. Connected to the piston is a handle 54. A piston rod 52 joins the piston to the handle. The piston includes a front face 58 and a rear face 60. Between the rear face 60 of the piston and the first end portion of the housing is a first coil spring 62 which biases the piston toward the right end portion 48 of the housing. Attached to the left end portion 46 of the housing is a cap 64. Attached to the right end portion 48 of the housing is a nozzle 66. As will be explained below, the right end portion of the housing also contains two valves, two chambers and two springs.

Surrounding the housing about its right end portion is a trigger sleeve 68 including a thumb lever 70. Adjacent the nozzle 66 is a fluid return mechanism 72 and a connector 74 for engagement with the supply tube. Located between the front face 58 of the piston 50 and the right end portion 48 of the housing is a first or main chamber 80 into which the liquid 38 (FIG. 2) from the container is drawn when the handle 54 is moved by a user to the left or away from the cap 64. In FIGS. 6–9, the wand is shown in a relaxed or non-pressurized mode as it would be during shipment, storage or when the wand is removed from the container.

Figure 9:
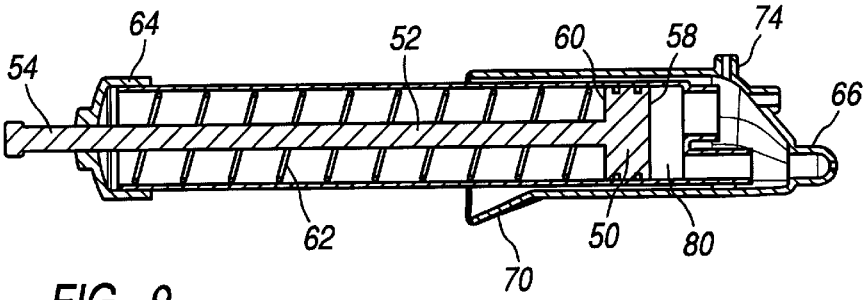
FIG. 9 is a sectional view taken along line 9—9 of FIG. 8.
Figure 10:
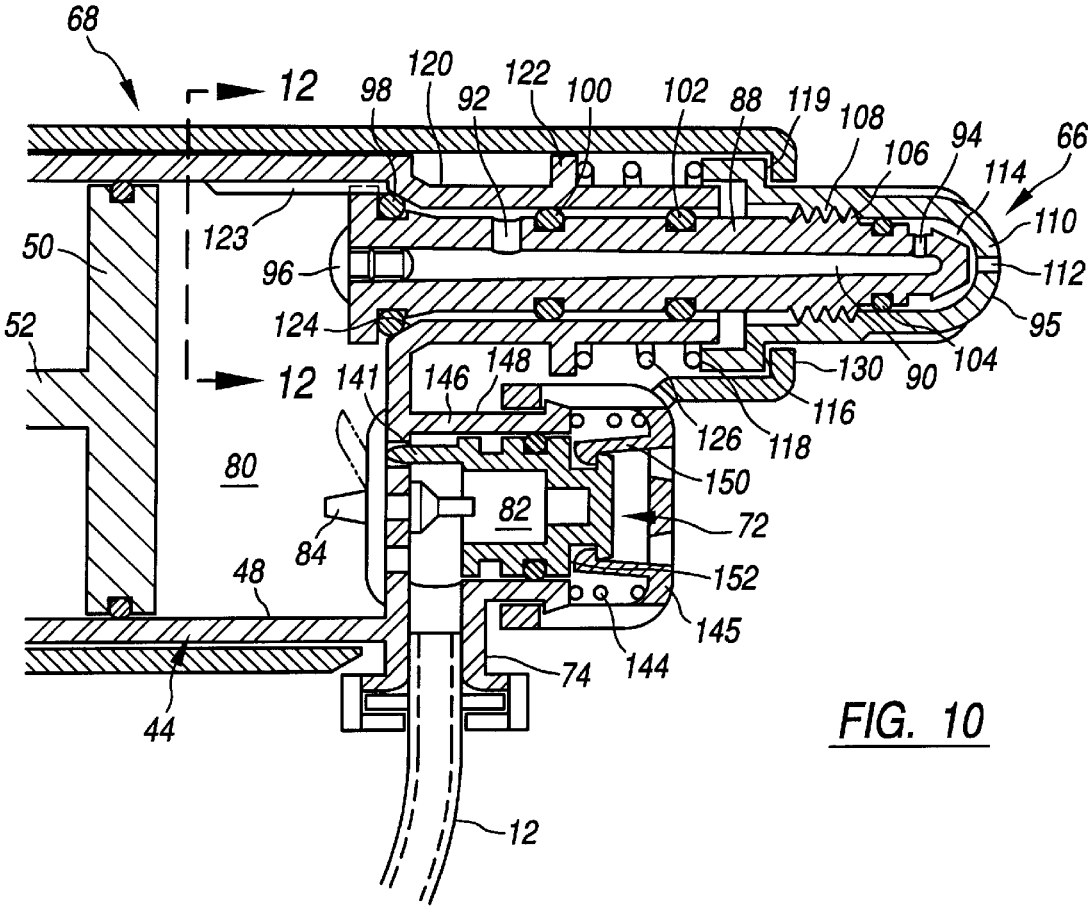
FIG. 10 is an enlarged sectional view taken within the circle 10—10 of FIG. 6 showing the valve in the apparatus in a closed position.
Figure 11:
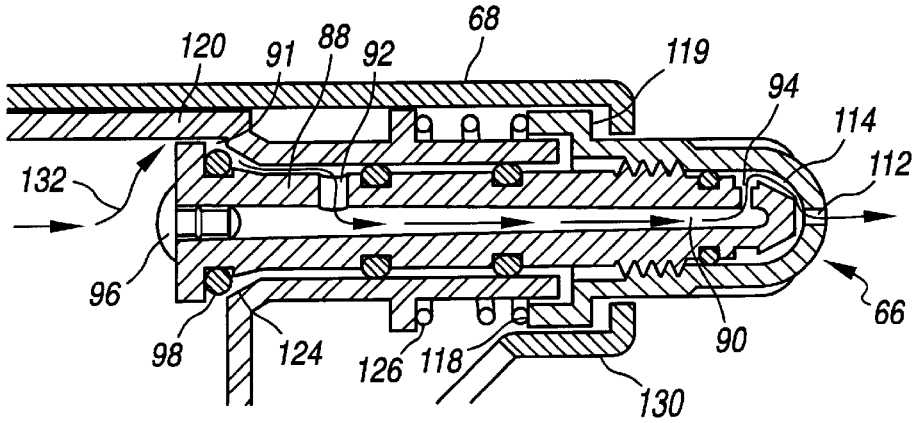
FIG. 11 is a partial view like that shown in FIG. 10 except the illustrated valve is shown in an open position.
Figure 12:
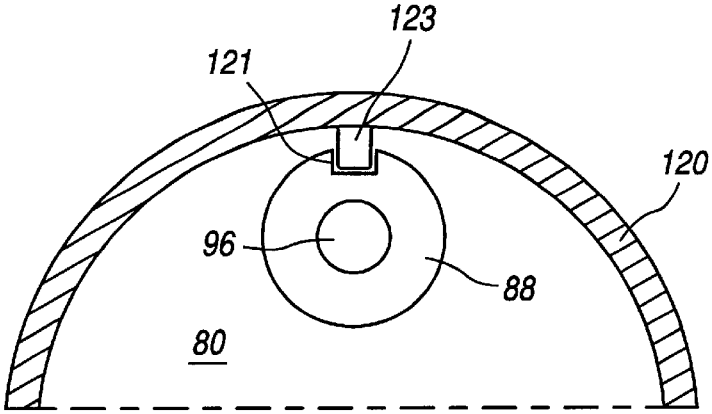
FIG. 12 is an enlarged sectional view taken along line 12—12 of FIG. 10.

Referring now to FIGS. 10–12, the relative simplicity and reliability of the pump and spray mechanisms may be seen. The sectional view of FIGS. 10 and 11 is of the right end portion 48 of the housing 44. The supply tube 12 is attached to the connector 74 which communicates with a second or small chamber 82. Separating the small chamber 82 from the main chamber 80 is a first valve 84, commonly called a check valve, which opens in one direction usually in response to a pressure differential across the valve. As the piston 50 (FIG. 9) is pulled to the left by a user, the main chamber 80 expands. This causes the pressure in the main chamber to decrease while the pressure acting on the liquid is atmospheric, thereby creating a pressure differential across the check valve 84. The pressure differential causes the valve to open, as shown in phantom line, and the liquid 38 to move from the container 10 through the supply tube and the small chamber 82 into the main chamber 80. In addition, as the piston 50 is pulled to the left, the coil spring 62 (FIG. 9) is steadily compressed. When the piston reaches the limit of its travel or the user stops the leftward movement of the handle, the main chamber 80 is filled with liquid and the spring 62 is completely or partially compressed. This compressed spring provides a biasing force against the rear face 60 of the piston and the liquid, thereby closing the check valve 84.

In parallel alignment with the check valve, there is a second valve including a valve stem 88 positioned within the housing at its right end portion. The valve stem has a central longitudinal opening 90, a first or left radial passage 92 and a second or right radial passage 94. A plug 96 seals the upstream end of the longitudinal opening 90. The second valve also includes a first O-ring seal 98 positioned about the outer circumference of the valve stem. The seal acts as a valve face. There is also included a second O-ring 100, a third O-ring 102 and a fourth O-ring 104 to seal various portions of the valve. There is also an outer threaded portion 106 about the circumference of the valve stem which engages an inner thread 108 on the nozzle 66. The threaded engagement of the valve stem and the nozzle ensures that they move or slide together when an external force is applied, and yet the nozzle and the valve stem may be moved relative to one another to adjust the spray projected from the nozzle. The nozzle 66 includes a rounded head 110 having a spray opening 112. Immediately internal to the nozzle and between the nozzle and the valve stem is a third or nozzle chamber 114. The nozzle also includes a ring shoulder 116, a ring edge 118 and an external shoulder 119.

The right end portion 48 of the housing includes a first sleeve portion 120 having an annular flange 122 about the outer circumference of the sleeve portion and an oblique annular surface 124 which functions as part of the second valve by being a valve seat. Between the flange 122 and the ring edge 118 is a second coil spring 126.

Positioned about a portion of the nozzle and the sleeve portion 120 is the trigger sleeve 68 which has an annular radially directed flange 130. This flange is constructed to abut the shoulder 119 of the nozzle. If the trigger sleeve is moved to the left by a user's thumb on the lever 70, FIGS. 6 and 7, it will cause the nozzle to slide to the left thereby moving the valve stem to the left and causing the O-ring seal or valve face 98 to move away from the oblique annular surface or valve seat 124 as shown in FIG. 11. When this happens, liquid represented by the arrow 132 may move around the end of the valve stem 88, past the valve face 98 and the valve seat 124, through an annular space 91 around the valve stem 88, through the radial passage 92, then to the longitudinal opening 90, through the radial passage 94, into the nozzle chamber 114 and out of the spray opening 112. When the user removes his thumb from the thumb lever 70, the second spring 126 will push the ring edge 118 of the nozzle to the right thereby causing both the nozzle and the valve stem to also slide rightwardly, which in turn, causes the valve face 98 and the valve seat 124 to abut each other to block the flow of liquid to the nozzle chamber 114.

Referring now to FIG. 12, the valve stem 88 includes a longitudinal slot 121 for receiving a longitudinally extending key 123. This mechanism is used to allow a user to rotate the nozzle relative to the valve stem while the valve stem is kept rotationally stationary. Nevertheless, the valve stem is allowed to move in a longitudinal direction in response to the rotation of the nozzle.

Figure 13:
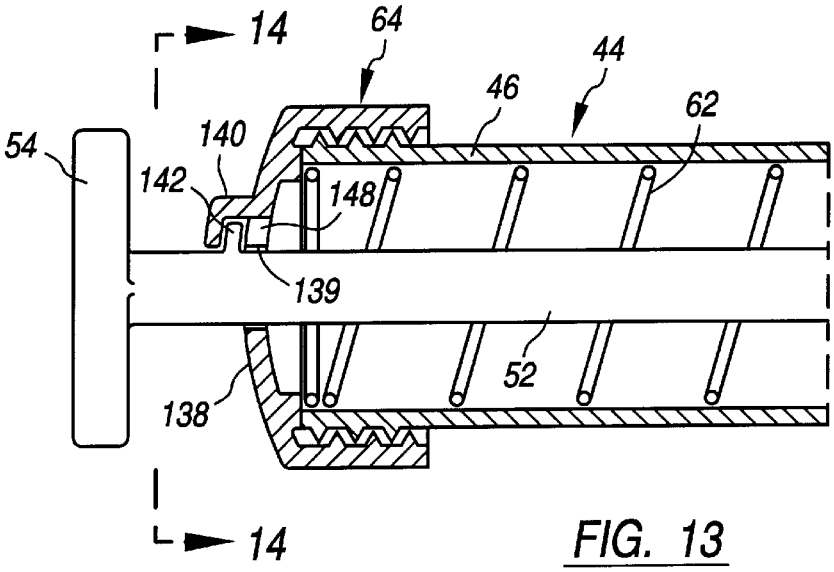
FIG. 13 is an enlarged sectional view taken within the circle 13—13 of FIG. 8.
Figure 14:
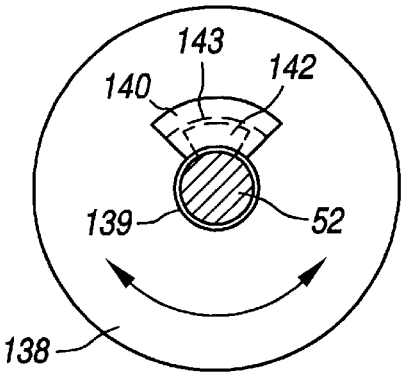
FIG. 14 is a sectional view taken along line 14—14 of FIG. 13 showing a handle of the hand holdable spray apparatus in a restrained position.
Figure 15:
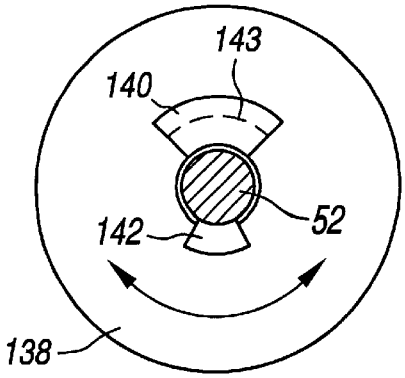
FIG. 15 is a view of the handle in an unrestrained position.

Referring now to FIGS. 13–15, there is illustrated another example of the elegant simplicity of the apparatus here. The left end portion 46 of the housing 44 is shown in more detail. The cap 64 is threadedly engaged with the housing and includes an outer surface 138 and a central opening 139. The central opening allows the piston rod 52 to extend beyond the end of the housing. The cap includes an arcuate flange 140 extending over an acute angle. Integral with the rod is an arcuate radially extending flange 142. When the piston 50 is in its most rightward position as generally shown in FIG. 9, the rod flange and the cap flange are in position to allow the rod flange to be trapped by the cap and the cap flange. Since the rod is cylindrical in form, it may be rotated from a trapped or restrained position as shown in FIGS. 13 and 14 to an untrapped or unrestrained position as shown in FIG. 15. In the trapped position, the pump is inoperative and unpressurized. This means that the first spring 62 is in a relaxed or almost relaxed condition. The cap may include a flange shape opening 143. When in the restrained position, the rod flange and the opening 143 align and the rod flange slides into the opening and is restrained against rotation as well as outward linear movement. However, by backing the handle to the left and simply rotating the handle 54 a half turn, or 180°, the rod flange moves to the unrestrained position and the wand may be pressurized by the user gripping the handle and pulling it to the left against the force of the compression spring. The wand may be made of any suitable material such as polypropylene.

Returning to FIG. 10 and as mentioned earlier, the liquid return mechanism 72 is provided as a safety feature to allow liquid in the main chamber 80 and the small chamber 82 to return to the container if it is not sprayed through the nozzle. This is done by forcing open the check valve 84. The liquid return mechanism includes a plunger 141, an activation button 145 and a third spring 144. The plunger 140 rides within a short second sleeve 146 of the housing 44 located in the right end portion 48. When the button 142 is pressed, it moves to the left by sliding on the outer circumference 148 of the second sleeve 146. In turn, an internal annular flange 150 of the button engages an annular shoulder surface 152 of the plunger causing the plunger to push against the check valve 84. This forces the check valve to open allowing the liquid in the main chamber 80 to enter the small chamber 82 and from there to the supply tube 12. From the supply tube, the liquid will flow back into the container 10. The driving force moving the liquid is provided by the first spring 62 (FIG. 9) applied to the rear face 60 of the piston 50.

Figure 16:
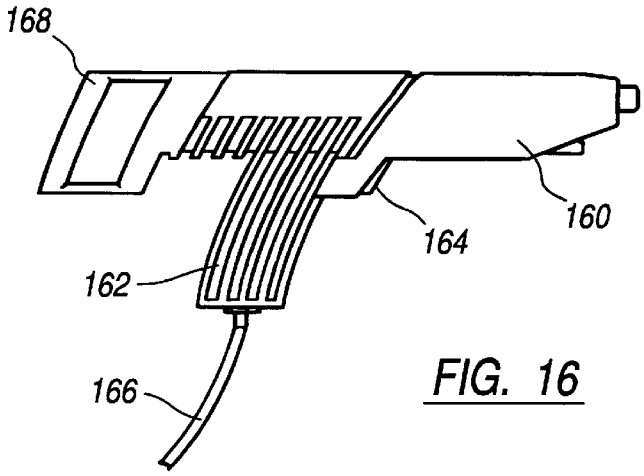
FIG. 16 is an elevational view of a variation pump spray apparatus of the present invention.

Referring to FIG. 16 another embodiment of the wand is illustrated. This hand holdable pump spray 160 is configured with a pistol grip 162 and a trigger 164. A supply tube 166 engages the bottom of the grip. A handle 168 is designed to be visually integrated with the remainder of the wand to provide a more aesthetically pleasing unit.

Figure 17:
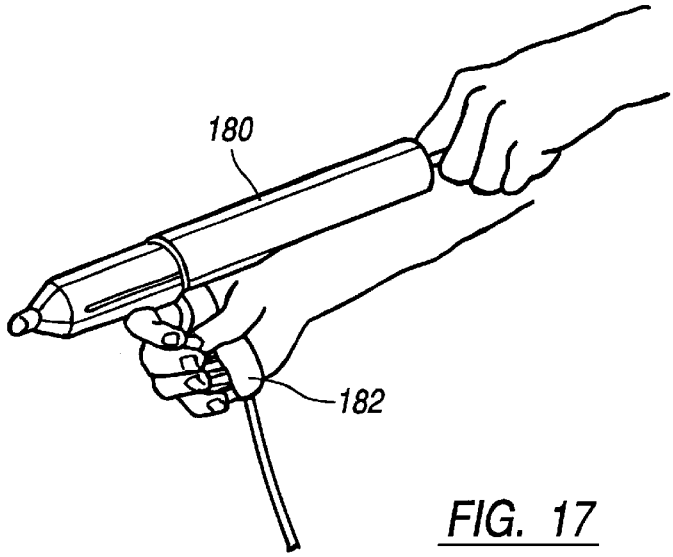
FIG. 17 is a perspective view of another variation pump spray apparatus of the present invention.

Referring now to FIG. 17, there is shown another embodiment of the present invention. The wand 180 which is illustrated is similar to the wand of the FIG. 1 embodiment except that the FIG. 17 variation has a piston grip 182.

Still another embodiment is shown in FIG. 18 which again is similar to the FIG. 1 embodiment except that the wand 190 is attached directly to the liquid container 192.

In operation, a user first removes the wand 14 from the sleeve 24 and unwraps the supply tube 12 from the bridge flange 40. The user then lifts the end 34 of the valve 28 to open the valve sealing the container. In the alternative structure the user lifts the valve element 31 to open the valve (in the FIGS. 4–5 embodiment) and plugs in the connector 35. Either of these actions communicates the valve with the internal tube 36, and thereby, the liquid 38 in the container 10.

Figure 6:
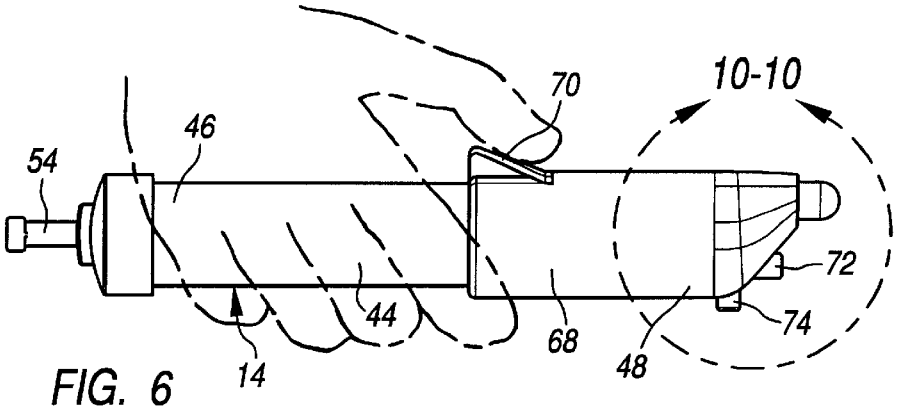
FIG. 6 is an enlarged front elevation view of a hand holdable pump spray apparatus of the present invention.
Figure 7:
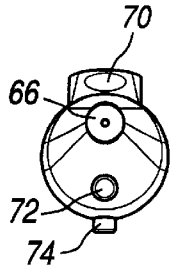
FIG. 7 is a side elevation view of the hand holdable pump spray apparatus shown in FIG. 6.
Figure 8:
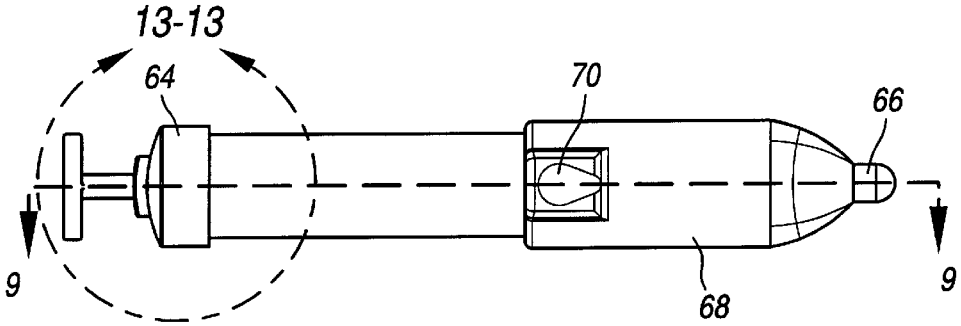
FIG. 8 is a top plan view of the hand holdable pump spray apparatus shown in FIG. 6.

To pressurize the system, the user holds the spray apparatus housing 44 in one hand and pulls the handle outward or to the left when viewed in FIGS. 6, 7 and 9. Liquid is drawn into the main chamber 80, while at the same time the coil spring 62 is compressed. When the main chamber 80 is filled, such as when the coil spring is fully compressed, the user may release the handle 54 and place his/her hand around the trigger sleeve 68 with his/her thumb on the thumb lever 70. When it is desired to actuate the system, the user pulls back on the trigger sleeve 68 causing the nozzle/valve stem combination to slide leftwardly and unseat the valve face 98 from the valve seat 124. When this is done, liquid will flow around the valve stem in the annular space 91 through the radial passage 92, through the longitudinal opening 90, out of the radial passage 94, and into the nozzle chamber 114. From there the liquid will be ejected through the nozzle opening 112. The nozzle spray may be adjusted by rotating the nozzle relative to the valve stem so as to change the relative location of the valve stem nose 95 to the nozzle opening 112. The liquid will be sprayed out of the nozzle opening 112 as long as the coil spring 62 biases the piston 50 to the right, causing the main chamber 80 to contract. When the coil spring 62 has reached its relaxed position, or if the piston is stopped such as by the shaft flange, the piston will no longer provide pressure on the liquid and the user will have to re-pressurize the wand by again moving the handle 54 to the left thereby compressing the spring 62 again, and enlarging and filling the main chamber 80. This may be done repeatedly until most of the liquid 38 has been drawn out of the container 10. At that time or before, the valve 28 or the valve element 31 may be rotated to a horizontal position to seal the container. The supply tube 12 and the wand may be removed and the container and residual liquid may be discarded. The supply tube and wand may then be reused by connecting the supply tube to a new, fully charged container. In the case of the FIGS. 4 and 5 variation, the connector 35 must be removed each time the container is sealed whether the container is discarded or not.

Should the spraying operation be finished before the spring 62 has reached its relaxed position, the button 145 of the fluid return mechanism may be depressed. This causes the plunger 141 to open the check valve 84, allowing the liquid in the main chamber to pass into the small chamber 82 and from there, into the supply tube and back to the container. In this manner the wand is depressurized and the liquid in the wand and supply tube is once again stored in the container. Once the liquid has returned to the container the pivot valve member may be rotated to a horizontal position to seal the container. Also the supply tube may be wrapped about the bridge flange and the wand may be inserted into the storage sleeve 24.

Figure 18:
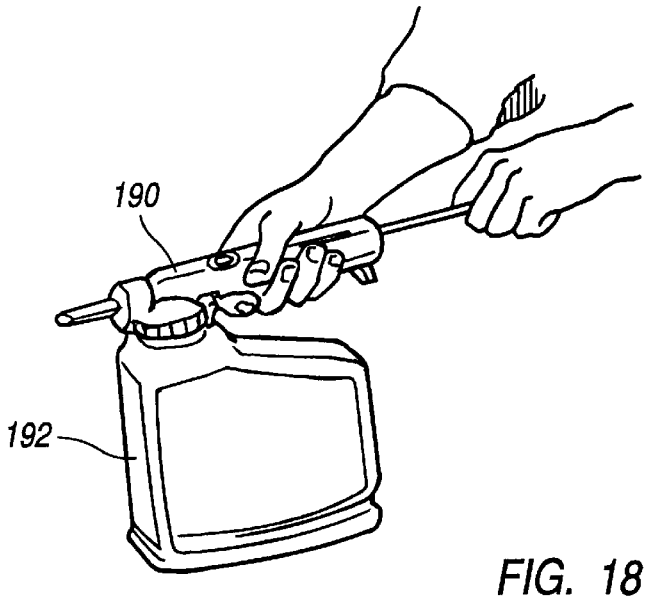
FIG. 18 is a perspective view of still a further modification of the present invention illustrating a pump spray apparatus attached to the top of a container.

The specification describes in detail several embodiments of the present invention. Other modifications and variations will, under the doctrine of equivalents, come within the scope of the appended claims. For example, a different trigger mechanism, valve stem or nozzle are considered equivalent structures as are different aesthetic designs. By way of further example, the variations of FIGS. 16–18 are equivalent even though appearances are greatly varied. Still other alternatives will also be equivalent as will many new technologies. There is no desire or intention here to limit in any way the application of the doctrine of equivalents.

What is claimed is:

1. A hand holdable pump spray apparatus comprising in combination:

a hand holdable generally tubular housing having first and second end portions;

a piston having two faces movable in said housing;

a handle connected to said piston and located outside said housing adapted to be gripped by a user to move said piston toward said first end portion of said housing;

a first spring located in said housing between one face of said piston and said first end portion of said housing to bias said piston toward said second end portion of said housing;

a first chamber formed in said housing between the other face of said piston and said second end portion of said housing;

a second chamber in connection with said housing operatively connected to a reservoir containing a liquid to be sprayed;

a first valve separating said second chamber from said first chamber;

a second valve mounted in said housing communicating with said first chamber;

a nozzle connected to said second end portion of said housing;

a second spring located in said housing to engage and bias said nozzle; and a hand operated trigger connected to said nozzle to move said nozzle and said second valve whereby liquid in said first chamber may be ejected through said nozzle.

2. An apparatus as claimed in claim 1 wherein:

said second valve includes a valve stem engaged to said nozzle;

said trigger causes a spray of liquid by moving said nozzle and said valve stem toward said first end portion of said housing whereby said second spring is compressed to provide a force to return said valve stem and said nozzle to a closed position; and said housing includes a first sleeve portion in which is mounted said valve stem.

3. An apparatus as claimed in claim 2 wherein:

said housing includes a second sleeve portion to mount a plunger for opening said first valve.

4. An apparatus as claimed in claim 3 including:

a plunger mounted in said second sleeve to engage and open said first valve to allow liquid located in said first chamber to flow into said second chamber and back to said reservoir.

5. An apparatus as claimed in claim 1 wherein:

said trigger is a generally tubular shaped element mounted about said housing.

6. An apparatus as claimed in claim 1 including:

an end cap connected to said first end portion of said housing, said end cap having a flange and wherein:

said handle includes a flange for engaging said flange of said end cap to restrain said handle from moving said piston.

7. An apparatus as claimed in claim 1 wherein:

said valve stem has a central opening operatively communicating with an opening in said nozzle.

8. An apparatus as claimed in claim 1 including:

a third chamber located between said second valve and said nozzle; and wherein said handle extends beyond the first end portion of said housing;

said second chamber is formed in said second end portion of said housing; and said first valve is located in said second end portion of said housing.

9. An apparatus as claimed in claim 4 including:

a third spring biasing said plunger away from engagement with said first valve.

10. An apparatus as claimed in claim 4 including:

a third chamber located between said second valve and said nozzle; and a third spring biasing said plunger away from engagement with said first valve.

11. A hand holdable pump spray system comprising in combination:

a container to hold a liquid to be sprayed; and a hand holdable pump spray apparatus separated from said container and including a housing having first and second end portions, a piston having two faces movable in said housing, a handle connected to the piston adapted to be gripped by a user to move said piston, a first spring located in said housing between one face of said piston and said first end portion of said housing to bias said piston toward said second end portion of said housing, a first chamber formed in said housing between the other face of said piston and said second end portion of said housing, a second chamber in communication with said second end portion of said housing operably connected to the liquid in said container, a first valve separating said second chamber from said first chamber, a second valve mounted in said second end portion of said housing communicating with said first chamber, a nozzle connected to said second end portion of said housing; a second spring located in said housing to engage said nozzle, a trigger connected to said nozzle to move said nozzle and said second valve whereby liquid in said first chamber may be ejected through said nozzle.

12. A system as claimed in claim 11 including:

a supply tube connecting said container to said hand held pump spray apparatus; and a storage sleeve connected to said container to hold said hand holdable pump spray apparatus.

13. A system as claimed in claim 12 wherein:

said second valve includes a valve stem engaged to said nozzle;

said trigger moves said nozzle and valve stem toward said first end portion of said housing when said trigger is activated whereby said second spring is compressed to provide a force on said valve stem and nozzle; and said housing including a first sleeve in which is mounted said valve stem.

14. A system as claimed in claim 13 wherein:

said housing includes a second sleeve for mounting a plunger; and including a safety valve connected to said container and said supply tube.

15. A system as claimed in claim 14 wherein:

said plunger is mounted in said second sleeve for engaging and opening said first valve to allow liquid in said first chamber to flow into said second chamber and back to said container.

16. A system as claimed in claim 15 including:

a third chamber located between said second valve and said nozzle;

a third spring biasing said plunger away from said engagement with said first valve.

17. A system as claimed in claim 16 including:

an end cap connected to said first end portion of said housing, said end cap having a flange; and wherein:

said handle includes a flange to engage said flange of said end cap to restrain said handle.

18. A system as claimed in claim 11 including:

a third chamber located between said second valve and said nozzle;

a third spring biasing said plunger away from engagement with said first valve.

19. A hand holdable pump spray system comprising in combination:

a container for containing a liquid to be sprayed;

a supply tube being removably connectable to said container;

a hand holdable pump spray apparatus including a housing having first and second end portions, a first sleeve and a second sleeve connected to said supply tube;

a piston movable in said housing;

a first chamber formed in the housing between said piston and said second end portion;

a second chamber formed in said second sleeve;

a nozzle connected to said housing;

a first valve located in said housing separating said first chamber from said second chamber;

a second valve located in said first sleeve of said housing separating said first chamber and said nozzle;

an opening in said housing for receiving said supply tube and communicating said supply tube with said second chamber;

a handle connected to said piston to move said piston relative to said housing;

a plunger engageable with said first valve; and a trigger to open said second valve.

20. A system as claimed in claim 19 including:

a first spring in said housing to bias said piston toward said second end portion of said housing;

a second spring in contact with said second valve to bias said second valve to a closed position; and a third spring to bias said plunger away from said second valve.

21. A system as claimed in claim 20 wherein:

said second spring is mounted about said first sleeve;

said handle includes a flange; and said another flange is connected to said housing to engage with said handle flange.

22. A systems as claimed in claim 21 wherein:

said second valve includes a valve stem; and including an O-ring mounted about said valve stem; and a valve seat formed by a portion of said first sleeve.

* * * * *